United States Patent [19]

Hsueh

[11] Patent Number: 4,696,345

[45] Date of Patent: Sep. 29, 1987

[54] HASDRIVE WITH MULTIPLE OFFSET PRODUCERS

[75] Inventor: Limin Hsueh, Buena Park, Calif.

[73] Assignee: Chevron Research Company, San Francisco, Calif.

[21] Appl. No.: 898,549

[22] Filed: Aug. 21, 1986

[51] Int. Cl.[4] ..... E21B 43/24; E21B 43/30

[52] U.S. Cl. ..... 166/245; 166/50; 166/272

[58] Field of Search ..... 166/50, 245, 263, 272

[56] References Cited

U.S. PATENT DOCUMENTS

| | | | |
|---|---|---|---|
| 3,994,340 | 11/1976 | Anderson et al. | 166/50 X |
| 4,020,901 | 5/1977 | Pisio et al. | 166/50 |
| 4,037,658 | 7/1977 | Anderson | 166/272 |
| 4,303,126 | 12/1981 | Blevins | 166/50 X |
| 4,384,613 | 5/1983 | Owen et al. | 166/245 X |
| 4,390,067 | 6/1983 | Willman | 166/50 X |
| 4,436,153 | 3/1984 | Carlson | 166/50 X |
| 4,460,044 | 7/1984 | Porter | 166/50 X |
| 4,535,845 | 8/1985 | Brown et al. | 166/272 |

FOREIGN PATENT DOCUMENTS

| | | | |
|---|---|---|---|
| 876968 | 10/1981 | U.S.S.R. | 166/245 |

*Primary Examiner*—George A. Suchfield

*Attorney, Agent, or Firm*—S. R. La Paglia; E. J. Keeling; E. A. Schaal

[57] ABSTRACT

The present invention is an improvement on the method of recovering viscous petroleum from a petroleum-containing formation by providing a steam injection well from the earth's surface through the formation, extending at least one lateral hole from the vicinity of the steam injection well through at least a portion of the formation, forming a flow path in the hole isolated from the formation for flow of fluid through the formation, circulating a hot fluid through the flow path to reduce the viscosity of the viscous petroleum in the formation adjacent the outside of the flow path to form a communication path for flow of petroleum in the formation outside of the flow path, and injecting a driving fluid into the formation through the steam injection well and the communication path to promote flow of petroleum in the formation to production wells penetrating the petroleum-containing formation for recovery from the formation. This improvement comprises having at least two of the production wells offset from the flow path by from 2% to 8% the distance from the steam injection well. Preferably, the offset production wells are located on both sides of the flow path and are offset from the flow path by from 3% to 6% the distance from the steam injection well. Preferably, the length of the flow path is at least 600 feet, and preferably there are at least four production wells per flow path.

4 Claims, 2 Drawing Figures

HASDRIVE (HEATED ANNULUS STEAM DRIVE)

HASDRIVE (HEATED ANNULUS STEAM DRIVE)

FIG.__1.

HASDRIVE WITH MULTIPLE OFFSET PRODUCERS

BACKGROUND OF THE INVENTION

This invention recovers viscous petroleum from petroleum-containing formations, such as tar sand. There are several major formations that contain petroleum which is too viscous to be recovered by ordinary production methods. Utah has about 26 billion barrels of such viscous petroleum. California has about 220 million barrels. The largest of these formations is in Alberta, Canada, which has almost 1000 billion barrels. The depths of these formations range from surface outcroppings to about 2000 feet.

To date, none of these formations have been commercially produced by an in-situ technology. The only commercial mining operation is in a shallow Athabasca deposit. A second mining project is now about 20% completed. However, there have been many in-situ well-to-well pilots. All of these pilots used thermal recovery after forming communication between injection well and production well. Normally this communication has been formed by introducing a pancake fracture. The drive mechanism has been either steam and combustion (the project at Gregoire Lake) or steam and chemicals (the early work on Lease 13 of the Athabasca deposit). Another means of forming communication has been proposed for the Peace River project, where steam will be injected for several years into an aquifer beneath the tar sand formation. Probably the most active in-situ tar sands pilot has been that at Cold Lake, which uses the huff-and-puff single-well method of steam stimulation. This project has been producing about 4000 barrels per day for several years from about 50 wells.

The most difficult problem in any in-situ tar sand project is forming and keeping communication between injection well and production well. In shallow formations, fracturing to the surface has sometimes interfered with maintaining a satisfactory drive pressure. Problems arise from plugging of the fracture when the heated viscous petroleum cools as it moves toward the production well. The cooled petroleum is almost immobile. For example, its viscosity in the Athabasca formations at reservoir temperature is on the order of 100,000 to 10 million cp. The major problem of forming and keeping communication between injection well and production well is primarily due to the character of the formations. The mobility of fluids may be very low or (as in the Athabasca Tar Sands) almost nil. Thus, the Athabasca Tar Sands are strip mined where the overburden is limited. In some tar sands, hydraulically fracturing has been used to form communication between injection wells and production wells. This has not met with uniform success. The problem is more difficult in the intermediate overburden depths and difficulty in controlling fracture duration, which cannot stand fracturing pressure.

Many methods have been used in trying to recover viscous petroleum from Athabasca tar sand formations. People have tried applying heat to these formations by steam or underground combustion. People have tried using slotted liners positioned in the formations as conduits for hot fluids. However, these methods have been unsuccessful because of the difficulty of forming and keeping communication between the injection well and the production well.

Donald J. Anderson et al. have disclosed a solution to this problem, in their U.S. Pat. No. 3,994,340, which is hereby incorporated by reference to show a HASDrive (Heated Annulus Steam Drive) method. Anderson et al. disclose recovering viscous petroleum from a petroleum-containing formation by providing a steam injection well from the earth's surface through the formation, extending at least one lateral hole from the steam injection well through at least a portion of the formation, forming a flow path (this flow path is commonly called a HAS pipe) in the hole isolated from the formation, circulating a hot fluid through the flow path to reduce the viscosity of the viscous petroleum in the formation adjacent the outside of the HAS pipe to form a communication path for flow of petroleum in the formation, and injecting a driving fluid into the formation through the steam injection well and the communication path to promote flow of petroleum in the formation to production wells penetrating the petroleum-containing formation for recovery from the formation.

The cost of drilling horizontal HAS pipe is high. As an alternative, increasing the pattern width can reduce the horizontal drilling cost per unit area, but as the pattern width increases the areal sweep efficiency decreases.

SUMMARY OF THE INVENTION

The present invention is an improvement on the method of Donald J. Anderson et al. In the present invention, at least two production wells are offset from the flow path by from 2% to 8% (preferably from 3% to 6%) of the distance from the steam injection well. Preferably, the offset production wells are located on both sides of the flow path. In one embodiment, the length of the flow path is at least 600 feet, and there are at least four production wells per flow path.

DETAILED DESCRIPTION OF THE PREFERRED EMBODIMENTS

Figure 1:
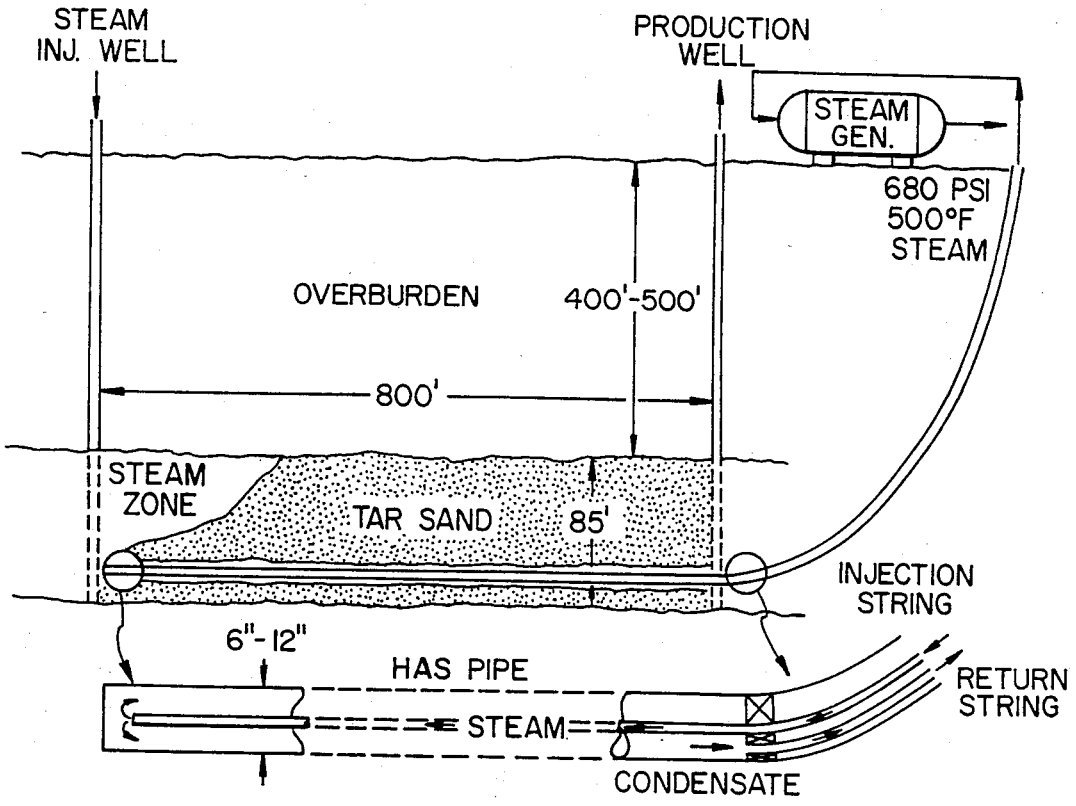
FIG. 1 is a cross-sectional representation of a heated annulus steam drive apparatus useful in the present invention.

The present invention is a method for recovering viscous petroleum from a petroleum-containing formation. It is particularly useful in formations where it is difficult to form and keep communication between an injection well and a production well. As shown in FIG. 1, a HAS pipe provides a heated communication path through the formation. In this method, a steam injection well is made from the earth's surface through the formation. At least one lateral hole (usually horizontal) is extended from the vicinity of the steam injection well through part of the formation. A pipe is placed in the lateral hole, and a flow path is created inside the pipe. This flow path, which is isolated from the formation by the HAS pipe, is for flow of hot fluid. A hot fluid is circulated through the flow path to reduce the viscosity of the petroleum in the formation adjacent to the outside of the HAS pipe by heating that petroleum and to form a communication path outside the HAS pipe for flow of that petroleum. A driving fluid is injected through the communication path via the steam injection well to promote flow of petroleum to a plurality of recovery positions. The recovery positions are production wells penetrating the formation near the flow path.

By the term "lateral hole" we mean a hollow opening forced through a formation that is directed toward the steam injection well. The lateral hole does not have to contact the steam injection well, as long as the lateral hole has its end sufficiently close to the steam injection well so as to assist that well.

At least two of the production wells are offset from the flow path. The amount of offset is from 2% to 8% the distance from the steam injection well. For instance, a production well 200 feet from the steam injection well should be from 4 feet to 16 feet from the flow path. Preferably, the offset production wells are located on both sides of the flow path and are offset from the flow path by from 3% to 6% the distance from the steam injection well. Preferably, the length of flow path is at least 600 feet, and preferably there are at least four production wells per flow path.

Preferably, both the hot fluid and the driving fluid are steam. In some cases, the hot fluid and the driving fluid may be injected simultaneously. In other cases, they are injected alternatively. The ability to inject the driving fluid into the formation is controlled by adjusting the flow of hot fluid through the flow path.

The HASDrive method can be used to recover viscous petroleum from an Athabasca-type formation. This is done by providing a steam injection well from the earth's surface through the formation and extending at least one substantially horizontal hole from the vicinity of the steam injection well through part of the formation. A solid-wall tube is inserted into the horizontal hole. This tube has a closed outer end. A flow pipe is inserted into the tube until it almost reaches the closed end of the hollow tube. The combination of the tube and the flow pipe is called a HAS Pipe. This HAS pipe provides a flow path through both the inside of the flow pipe and the annulus. A hot fluid is circulated through that HAS pipe to reduce the viscosity of the petroleum in the formation near the outside of the HAS pipe by heating that petroleum, and to form a communication path outside the HAS pipe for flow of that petroleum. A driving fluid is forced into the formation through the communication path to promote petroleum flow near the hollow tube to production wells. As noted, steam is both the preferred hot fluid and the preferred driving fluid, although other fluids may be used.

Figure 2:
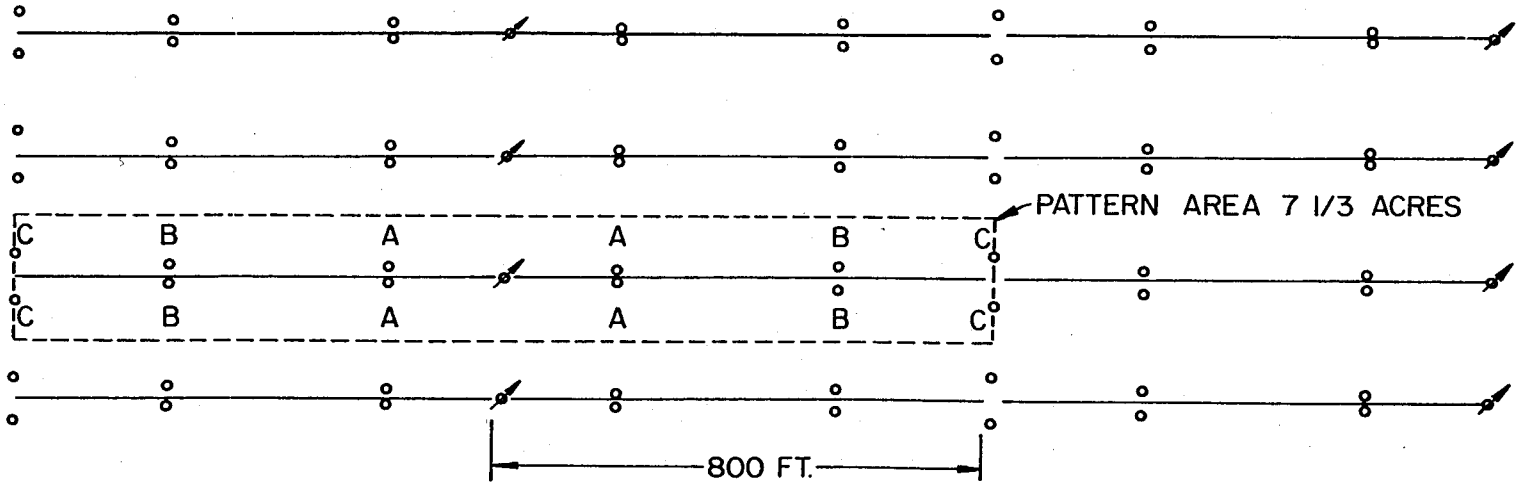
FIG. 2 is an aerial view of a well pattern of one embodiment of the present invention.

Instead of having production wells only at the end of the HAS pipe, additional production wells are located offset from the HAS pipe. FIG. 2 shows an aerial view of a base case well pattern of one such embodiment. This pattern is 1600 feet long and 200 feet wide, with a pattern area of over 7 acres. In this well pattern, there are two HAS pipes and ten production wells for each steam injection well. Although there are four production wells 800 feet from each steam injection well, each of those production wells draw from two injection wells. In this pattern, four of the production wells (Set A) are at 190 feet from the steam injection well and 7 feet from the HAS pipes (3.7% offset). Four of the production wells (Set B) are 550 feet from the steam injection well and 17.5 feet from the HAS pipes (3.2% offset). Two of the production wells (Set C) are 800 feet from the steam injection well and 40 feet from the HAS pipes (5% offset).

The offset production wells are near the communication path established by the HAS pipe, but being offset, improve the areal sweep efficiency. The Set A and Set B offset wells provide the means for early year production since the steam bank does not have to travel as far to a production well. When the steam-oil ratio in an offset production well (Set A or Set B) increases beyond a certain limit, that offset production well is shut in and production continues in the remaining production wells. In addition, being located out into the formation from the HAS pipe, all the offset production wells encourage improved radial heating similar to what would be obtained by a larger diameter HAS pipe.

While the modified HASDrive system has been described with reference to particularly preferred embodiments, modifications which would be obvious to the ordinary skilled artisan are contemplated to be within the scope of this invention.

What is claimed is:

1. In the method of recovering viscous petroleum from a petroleum-containing formation comprising:

(a) providing a steam injection well from the earth's surface through the formation, (b) extending at least one lateral hole from the vicinity of the steam injection well through at least a portion of the formation, (c) forming a flow path in the hole isolated from the formation for flow of fluid through the formation, (d) circulating a hot fluid through the flow path to reduce the viscosity of the viscous petroleum in the formation adjacent the outside of the flow path to form a communication path for flow of petroleum in the formation outside of the flow path, and (e) injecting a driving fluid into the formation through the steam injection well and the communication path to promote flow of petroleum in the formation to production wells penetrating the petroleum-containing formation for recovery from the formation, The Improvement Comprising having at least two of the production wells offset from the flow path by from 2% to 8% the distance from the steam injection well.

2. The method according to claim 1 wherein the offset production wells are offset from the flow path by from 3% to 6% the distance from the steam injection well.

3. The method according to claim 1 wherein the offset production wells are located on both sides of the flow path.

4. The method according to claim 1 the length of the flow path is at least 600 feet, and wherein there are at least four production wells per flow path.

* * * * *